US006024436A

United States Patent [19]

Katakura et al.

[11] Patent Number: 6,024,436

[45] Date of Patent: Feb. 15, 2000

[54] LAMINATED INK JET RECORDING HEAD

[75] Inventors: Takahiro Katakura; Kazumi Kamoi; Minoru Usui, all of Nagano, Japan

[73] Assignee: Seiko Epson Corporation, Tokyo, Japan

[21] Appl. No.: 08/832,671

[22] Filed: Apr. 4, 1997

[30] Foreign Application Priority Data

Apr. 4, 1996 [JP] Japan ..... 8-108382

[51] Int. Cl.[7] ..... B41J 2/145

[52] U.S. Cl. ..... 347/40

[58] Field of Search ..... 347/70, 71, 40

[56] References Cited

U.S. PATENT DOCUMENTS

| | | | |
|---|---|---|---|
| 4,502,059 | 2/1985 | Blessington . | |
| 4,771,298 | 9/1988 | Lee et al. . | |
| 5,748,214 | 5/1998 | Usui et al. | 347/70 |

FOREIGN PATENT DOCUMENTS

| | | | |
|---|---|---|---|
| 505188 | 9/1992 | European Pat. Off. | 347/71 |
| 0572231 | 12/1993 | European Pat. Off. . | |
| 0648607 | 4/1995 | European Pat. Off. . | |
| 0653304 | 5/1995 | European Pat. Off. . | |
| 2182611 | 5/1987 | United Kingdom . | |

OTHER PUBLICATIONS

Patent Abstract of Japan, V 11, N. 149 (M–588), May 15, 1987 of JP 61–283554 A (Ricoh Co Ltd), Dec. 13, 1986.

Patent Abstract of Japan, vol. 97, No. 10, Oct. 31, 1997 of JP 09–150508 A (NEC Corp), Jun. 10, 1997.

*Primary Examiner*—N. Le

*Assistant Examiner*—Michael Nghiem

*Attorney, Agent, or Firm*—Sughrue, Mion, Zinn, Macpeak & Seas, PLLC

[57] ABSTRACT

Nozzle openings 18-1, 18-2, 18-3, . . . are formed so as to stagger, and pressure generating chambers 7-1, 7-2, 7-3, . . . , communicating holes 10-1, 10-2, 10-3, . . . , and ink supply ports 12 are arranged at uniform positions relative to one another with respect to the pressure generating chambers 7-1, 7-2, 7-3, . . . so as to match a mode of arraying nozzle openings 18-1, 18-2, 18-3, . . . . As a result of this construction, a bonding area is increased by shifting the positions of the nozzle openings 18-1, 18-2, 18-3, . . . , whose diameter is particularly small, in an axial direction of the pressure generating chambers.

30 Claims, 3 Drawing Sheets

LAMINATED INK JET RECORDING HEAD

BACKGROUND OF THE INVENTION

1. Field of the Invention

The present invention relates to a laminated ink jet recording head that is formed by laminating at least a first cover member, a spacer, and a second cover member and that is fixed to a passage unit having nozzle openings and common ink chambers, the first cover member having piezoelectric vibrators fixed to a surface thereof, the spacer forming pressure generating chambers therein, the second cover member having communicating holes communicating with the common ink chambers and a nozzle plate.

2. Description of the Prior Art

Using ink droplets to form dots on a recording medium, ink jet recording heads can implement extremely high resolution printing by reducing the size of each ink droplet. However, in order to print data efficiently, the number of nozzle openings must be increased, and when piezoelectric vibrators are used as an ink droplet jetting source, the downsizing of the piezoelectric vibrators is an essential consideration.

By the way, an ink jet recording head using flexural vibration as an actuator, the actuator unit, which includes a first cover member having piezoelectric vibrators fixed to a surface thereof, a pressure generating chamber forming board forming pressure generating chambers, and a second cover member, can be made of ceramics. As a result, no adhesive is required to bond these members to one another. On the other hand, a passage unit that supplies ink to the actuator unit and jets the ink pressured by the pressure generating chambers in the form of ink droplets must have a number of nozzle openings, each being formed with high accuracy to a diameter of about several tens of $\mu$m. As a result, a thin plate made of metal is usually used and is bonded to the actuator unit through an adhesive.

However, if the nozzle openings are pitched at a small interval, e.g., at an interval of about 210 $\mu$m, a bonding area becomes extremely narrow. As a result, the nozzle openings are clogged due to the adhesive flowing into the nozzle openings and ink leakage occurs, which in turn has caused the problem of impaired ink jetting performance.

SUMMARY OF THE INVENTION

The present invention has been made in view of the aforementioned problem. The object of the present invention is therefore to provide a novel laminated ink jet recording head that has an increased bonding area in the vicinity of nozzle openings that are pitched at a high density.

To overcome the aforementioned problem, the present invention is applied to a laminated ink jet recording head comprising: (A) an actuator unit including: pressure generating chambers for pressurizing an ink; and piezoelectric vibrators arranged on the pressure generating chambers; the piezoelectric vibrators expanding and contracting the pressure generating chambers to jet the ink in the pressure generating chambers; and (B) a passage unit bonded to the actuator unit, including: ink supply ports for supplying the ink to the pressure generating chambers of the actuator unit; and nozzle openings for jetting out the ink; wherein the ink supply ports, pressure generating chambers and nozzle openings are communicated by communicating holes provided in the actuator and passage units, the nozzle openings are formed so as to stagger, and the pressure generating chamber, communicating hole, and ink supply port are arranged at uniform positions relative to one another with respect to the pressure generating chamber so as to match a mode of arraying of the nozzle openings.

The bonding area is increased by shifting the positions of the nozzle openings and the ink supply ports, whose diameter is particularly small, in the axial direction of the pressure generating chambers. In addition, distortions derived from the boring of these nozzle openings and ink supply ports are scattered.

DETAILED DESCRIPTION OF THE PREFERRED EMBODIMENT

Figure 1:
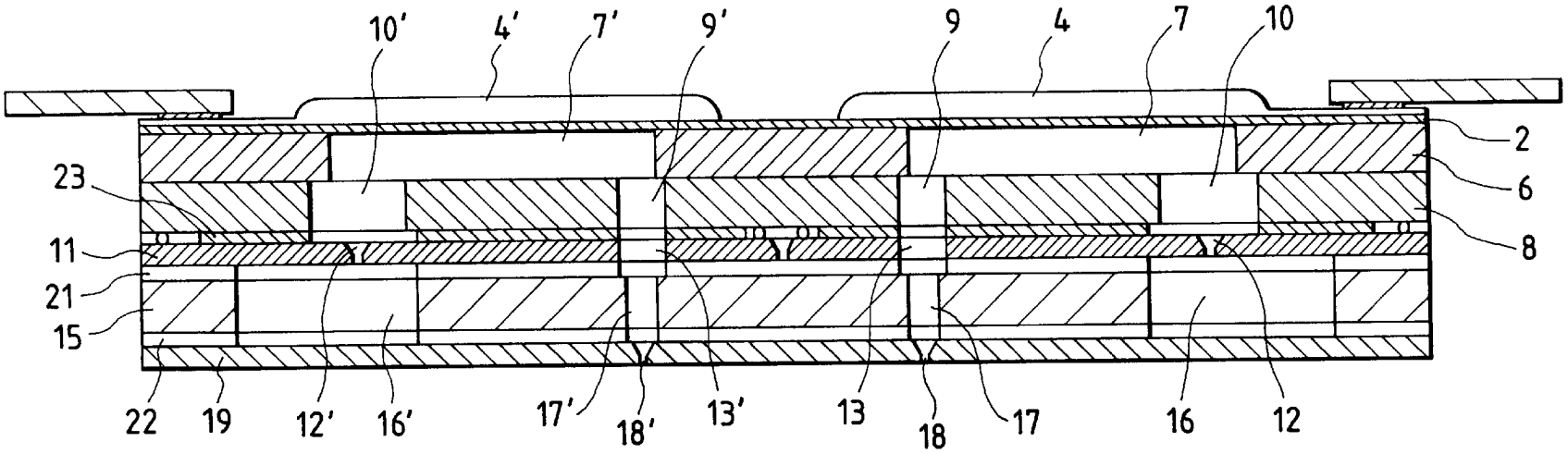
FIG. 1 is a sectional view of an ink jet recording head, which is an embodiment of the invention, showing a section close to pressure generating chambers in enlarged form.

Details of the present invention will now be described with reference to an embodiment shown in the drawings.

FIG. 1 is a sectional view showing a structure of an inkjet recording head having pressure generating chambers. In FIG. 1, reference numeral 2 denotes a first cover member that is made of a zirconia thin plate whose thickness is about 10 $\mu$m. Drive electrodes are formed on the surface of the first cover member so as to confront pressure generating chambers 7, 7'. Piezoelectric vibrators 4, 4' made of PZT or the like are fixed onto the surfaces of the drive electrodes.

Reference numeral 6 denotes a spacer, also known as a pressure generating forming board, which is formed by boring through holes in a ceramic plate such as zirconia ($ZrO_2$), the ceramic plate having such a suitable thickness as to form the pressure generating chambers 7, 7' therein, such thickness being, e.g., 150 $\mu$m. The pressure generating chambers 7, 7' are formed in the spacer 6 with both surfaces of the spacer 6 sealed by a second cover member 8 to be described later and the first cover member 2.

These pressure generating chambers 7, 7' contract and expand in response to flexural vibration from the piezoelectric vibrators 4, 4', so that not only ink droplets are jetted out of nozzle openings 18, 18' but also ink in common ink chambers 16, 16' is sucked through ink supply ports 12, 12'.

Reference numeral 8 denotes the second cover member, which is formed by boring nozzle communicating holes 9, 9' and communicating holes 10, 10' similarly in a ceramic plate made of zirconia or the like so that the positions of these holes 9, 9' and 10, 10' can match the positions of the pressure generating chambers 7, 7' respectively. The nozzle communicating holes 9, 9' connect the nozzle openings 18, 18' to the pressure generating chambers 7, 7', and the communicating holes 10, 10' connect the pressure generating chambers 7, 7' to the ink supply ports 12, 12'.

These members 2, 6, 8 are assembled into the actuator unit without using an adhesive. That is, these members 2, 6, 8 are formed by molding a clay-like ceramic material into predetermined shapes and laminating and sintering such shapes.

Reference numeral 11 denotes an ink supply port forming board, which serves also as an actuator unit fixing board. The ink supply port forming board 11 is formed by boring the ink supply ports 12, 12' and nozzle communicating holes 13, 13'. The ink supply ports 12, 12' determine passage resistance between the pressure generating chambers 7, 7' and the common ink chambers 16, 16'. The nozzle communicating holes 13, 13' connect the pressure generating chambers 7, 7' to the nozzle openings 18, 18'.

Reference numeral 15 denotes a common ink chamber forming board, which is formed by boring through holes that correspond to the shape of the common ink chambers 16, 16' and communicating holes 17, 17' that connect the nozzle openings 18, 18' to the pressure generating chambers 7, 7'. These through holes and communicating holes are formed in a corrosion-resistant plate such as a stainless steel plate having such a suitable thickness as to form the common ink chambers 16, 16', such thickness being, e.g., 150 $\mu$m.

Reference numeral 19 denotes a nozzle plate, which is formed by forming the nozzle openings 18, 18' in the form of arrays at positions communicable with not only nozzle communicating holes 9, 9' of the actuator unit, the communicating holes 13, 13' of the ink supply port forming board 11, and the communicating holes 17, 17' of the common ink chamber forming board 15. These ink supply port forming board 11, common ink chamber forming board 15, and nozzle plate 19 are assembled into a passage unit with adhesive layers 21, 22, 23 interposed therebetween, each adhesive layer being formed of a thermal deposition film, an adhesive, or the like.

The thus constructed actuator unit and passage unit are fixed to each other through an adhesive layer, whereby the ink jet recording head is formed.

Figure 2:
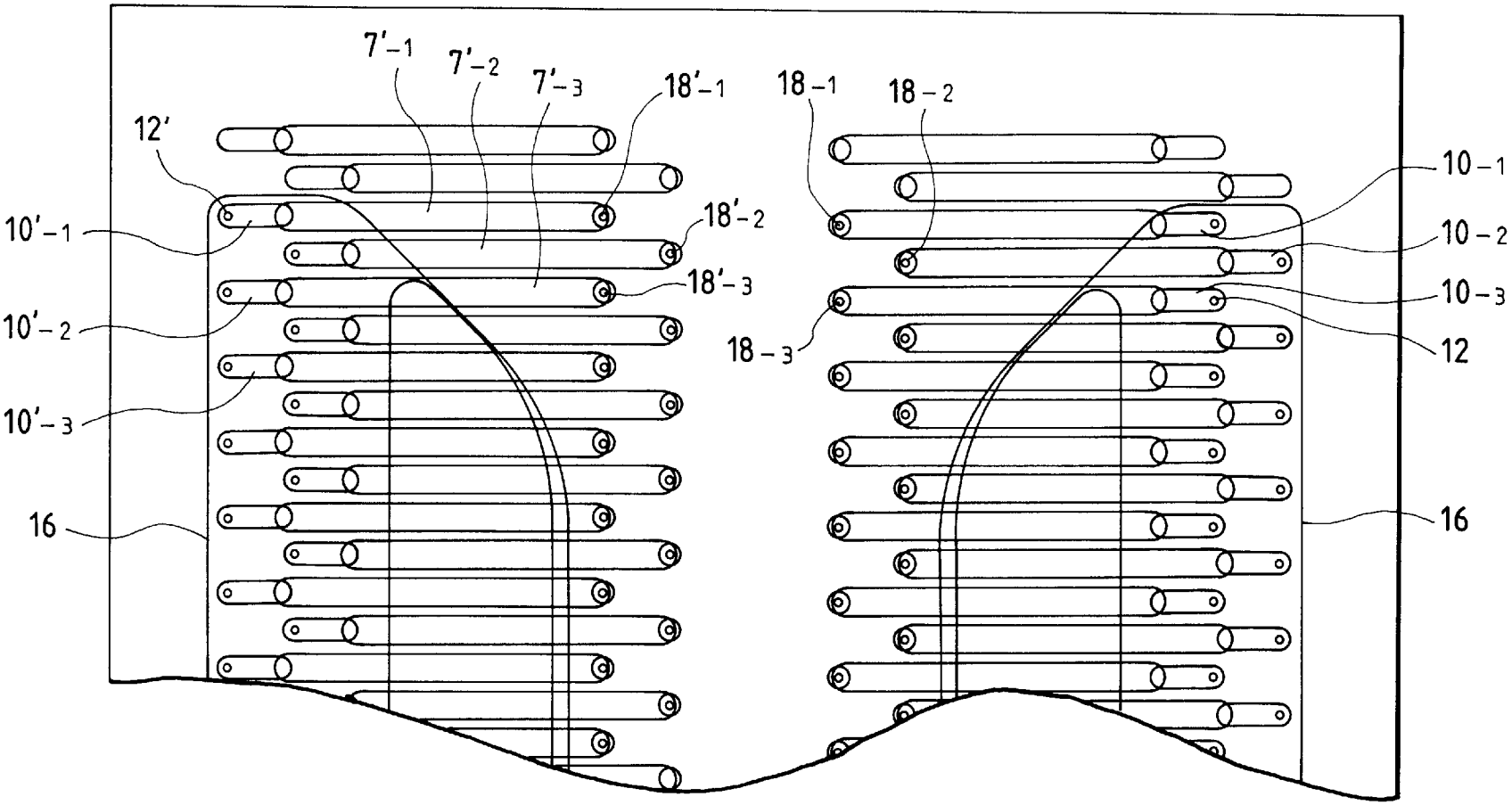
FIG. 2 is a diagram showing a positional relationship among pressure generating chambers, nozzle openings, and communicating holes in the recording head shown in FIG. 1.

By the way, the present invention is characterized as positioning the pressure generating chambers 7, 7', the ink supply ports 12, 12', the communicating holes 10, 10', and the like in such a relationship as shown in FIG. 2. That is, a nozzle opening in one array is staggered by a plurality of dots with respect to a nozzle opening in the same array in the horizontal direction as viewed in FIG. 2. More specifically, nozzle openings 18-1, 18-2, 18-3 . . . in one array are staggered with one another by a plurality of dots in the horizontal direction as viewed in FIG. 2, and the same applies to nozzle openings 18'-1, 18'-2, 18'-3 . . . in the other array. Further, a nozzle opening in one array is staggered by half a pitch with respect to a corresponding nozzle opening in the other array. More specifically, the two arrays of nozzle openings 18-1, 18-2, 18-3 . . . , 18'-1, 18'-2, 18'-3 . . . are staggered not only horizontally in intra-array terms but also vertically in inter-array terms.

Pressure generating chambers are similarly positioned to stagger so that the pressure generating chambers confront the corresponding nozzle openings under a predetermined positional relationship. More specifically, the pressure generating chambers 7-1, 7-2, 7-2 . . . corresponding to the nozzle openings 18-1, 18-2, 18-3 . . . in one array are staggered with one another substantially by a plurality of dots in the horizontal direction as viewed in FIG. 2 so that the ends of the pressure generating chambers facing the center of the recording head confront the corresponding nozzle openings 18-1, 18-2, 18-3 . . . in one array so as to keep a predetermined positional relationship, and the same applies to the pressure generating chambers 7'-1, 7'-2, 7'-3 . . . corresponding to the nozzle openings 18'-1, 18'-2, 18'-3 . . . in the other array. Further, a pressure generating chamber corresponding to one nozzle opening array is staggered by half a pitch with respect to a corresponding pressure generating chamber corresponding to the other nozzle opening array.

Likewise, the communicating holes 9, 9', 13, 13', 17, 17' connecting the nozzle openings 18-1, 18-2, 18-3 . . . , 18'-1, 18'-2, 18'-3 . . . to the pressure generating chambers 7-1, 7-2, 7-3 . . . , 7'-1, 7'-2, 7'-3 . . . are positioned to stagger with one another so that the nozzle openings 18-1, 18-2, 18-3 . . . , 18'-1, 18'-2, 18'-3 . . . can be connected to the pressure generating chambers 7-1, 7-2, 7-3 . . . , 7'-1, 7'-2, 7'-3 . . . through linear passages, respectively. Further, the communicating holes 10, 10' connecting the ink supply ports 12, 12' to the pressure generating chambers 7, 7' are arranged at such uniform positions relative to one another that ink from the ink supply ports 12, 12' can flow into predetermined positions of the pressure generating chambers 7, 7'.

Figure 3:
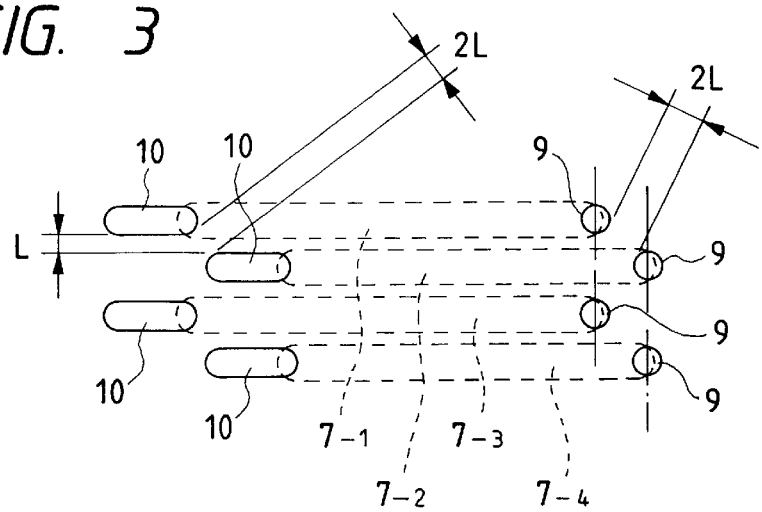
FIG. 3 is a diagram showing distances between communicating holes formed in a second cover member of the recording head shown in FIG. 1.

As shown in FIG. 3, if it is assumed that the distance, in arrangement direction of the communicating holes 10, between the adjacent communicating holes 10 connecting each of the pressure producing chambers 7-1, 7-2, 7-3 . . . in each array to the corresponding ink supply port 12 supplying the ink to the pressure generating chamber is L, the communicating holes 10 and nozzle communicating holes 9 may be positioned so that the shortest distance between adjacent communicating holes 10 and the shortest distance between adjacent nozzle communicating holes 9 connecting the nozzle openings 18 to the pressure generating chambers 7 are equal to or greater than 2L.

Assuming again that the distance between adjacent communicating holes 10 is L, the communicating holes 10 and nozzle communicating holes 9 may be positioned so that the shortest distance between adjacent nozzle communicating holes 9 is equal to or greater than 4L. Thus, a bonding area close to each nozzle opening at which the flow of ink, in particular, greatly affects printing quality can be increased. Therefore, not only the flow of an adhesive into the nozzle openings 18, 18' can be prevented at the time of bonding, but also distortions close to the nozzle openings 18, 18' and the ink supply ports 12, 12' for which the operation of boring tiny through holes is required to be performed can be scattered.

Figure 4:
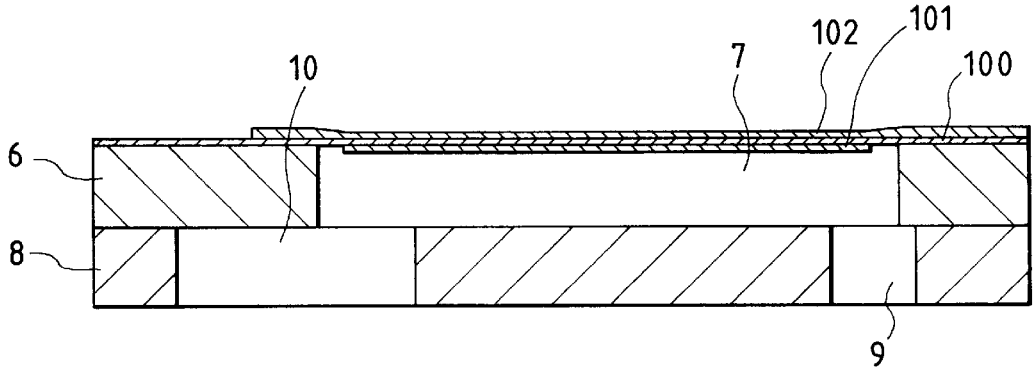
FIG. 4 is a cross sectional view showing pressure generating chambers and their related portions in one actuator unit in another ink jet print head of the invention.
Figure 5:
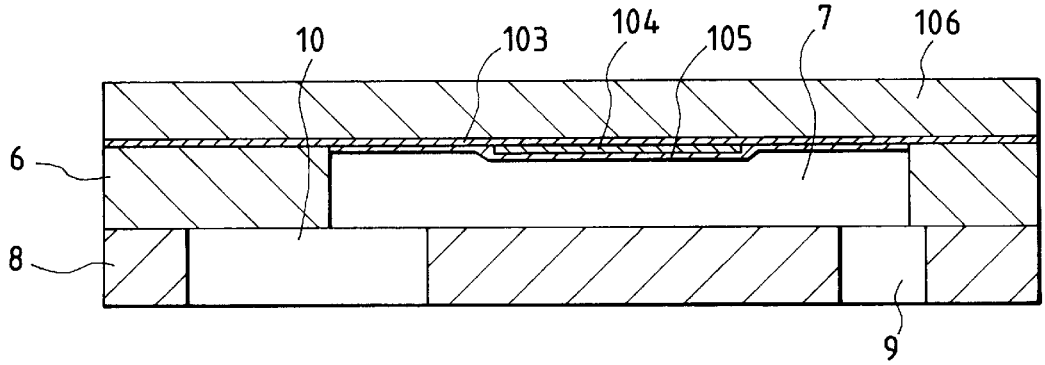
FIG. 5 is a cross sectional view showing pressure generating chambers and their related portions in one actuator unit in still further ink jet print head of the invention.

In the afore-mentioned actuator unit, the pressure generating portion (means) comprises the first chamber member 2, the piezoelectric vibrators 4 and lower and upper electrodes (not shown) shown in FIG. 1. Alternatively, the pressure generating portion which comprises piezoelectric vibrating plates 100, lower electrodes 101 and upper electrodes 102 so as to seal a surface of the space may be applied as shown in FIG. 4. Furthermore, the pressure generating portion comprising cover plates 106, electrically conductive layer 103, heating cover plates 106, electrically conductive layer 103, heating elements 104 and protective layer 105 may be used as shown in FIG. 5. Other constitutions which makes the pressure in the pressure generating chamber changer may be used for the present invention.

As described in the foregoing, the present invention is characterized as not only forming nozzle openings so as to stagger but also arranging pressure generating chambers, communicating holes, and ink supply ports at uniform positions relative to one another so as to match a mode of arraying of the nozzle openings. Therefore, the bonding area can be increased by shifting the positions of the nozzle openings and ink supply ports, whose diameter is particularly small, in the axial direction of the pressure generating chambers. As a result, not only sufficient bonding strength can be ensured, but also the flow of an adhesive into these nozzle openings and ink supply ports can be prevented. In addition, distortions derived from the boring of the nozzle openings and the ink supply ports can be scattered to thereby ensure high positioning accuracy.

What is claimed is:

1. A laminated ink jet recording head having a first nozzle array and a second nozzle array corresponding to a first pressure generating chamber array, said ink jet recording head comprising:

(A) an actuator unit comprising:

a pressure generating chamber forming board having pressure generating chambers, forming said first pressure generating chamber array, for pressurizing ink; and pressure generating means arranged on said pressure generating chamber forming board, said pressure generating means pressurizing said pressure generating chambers to jet the ink in said pressure generating chambers; and (B) a passage unit bonded to said actuator unit, comprising:

an ink supply port forming board having ink supply ports for supplying the ink to said pressure generating chambers of said actuator unit; and a nozzle plate having nozzle openings corresponding to said first nozzle array and said second nozzle array, for jetting out the ink from said pressure generating chambers;

wherein said ink supply ports, said pressure generating chambers and said nozzle openings communicate via a plurality of sets of communicating holes provided in said actuator unit and said passage unit;

wherein said first pressure generating chamber array extends generally in a lengthwise direction; and wherein said nozzle openings corresponding to said first nozzle array and said nozzle openings corresponding to said second nozzle array extend generally in the lengthwise direction of said first pressure generating chamber array, and are staggered with respect to each other in a widthwise direction of said first pressure generating chamber array to form a predetermined pattern.

2. The ink jet recording head according to claim 1, wherein said pressure generating chamber forming board comprises at least a first surface and a second surface; and wherein said actuator unit further comprises:

a first cover member for covering said first surface of said pressure generating chamber forming board; and a second cover member for covering said second surface of said pressure generating chamber forming board, said second cover member having a first set of said plurality of sets of communicating holes connecting said ink supply ports to said pressure generating chambers and a second set of said plurality of sets of communicating holes connecting said pressure generating chambers to a third set of said plurality of sets of communicating holes; and wherein said ink supply forming board comprises said third set of said communicating holes connecting said second set of communicating holes to a fourth set of said communicating holes;

said passage unit further comprising a common ink chamber forming board having common ink chambers communicating with said pressure generating chambers through said ink supply ports and said fourth set of said communicating holes connecting said third set of communicating holes and said nozzle openings; and wherein said nozzle plate seals one surface of said common ink chamber forming board.

3. The ink jet recording head according to claim 2, wherein said first set of said communicating holes and said second set of said communicating holes are positioned in the predetermined pattern so that a shortest distance between adjacent communicating holes of said first set of said communicating holes and a shortest distance between adjacent communicating holes of said second set of said communicating holes formed in said second cover member are equal to or greater than 2L, where L is a lengthwise component of a distance between adjacent rows of said first set of said communicating holes.

4. The ink jet recording head according to claim 2, wherein said pressure generating means comprises piezoelectric vibrators, said piezoelectric vibrators being arranged on said first cover member.

5. The ink jet recording head according to claim 1, wherein said actuator unit and said passage unit are bonded by an adhesive.

6. The ink jet recording head according to claim 1, further comprising a second pressure generating a chamber array comprising pressure generating chambers;

a third nozzle array and a fourth nozzle array, each having nozzle openings arranged on said nozzle plate and corresponding to said second pressure generating chamber array;

wherein said second pressure generating chamber array extends generally in a lengthwise direction; and wherein said nozzle openings corresponding to said third nozzle array and said nozzle openings corresponding to said fourth nozzle array extend generally in the lengthwise direction of said second pressure generating chamber array, and are staggered with respect to each other in a widthwise direction of said second pressure generating chamber array to form the predetermined pattern.

7. The ink jet recording head according to claim 6, wherein said nozzle openings corresponding to said first nozzle array and said nozzle openings corresponding to said second nozzle array are staggered with respect to said nozzle openings corresponding to said third nozzle array and said nozzle openings corresponding to said fourth nozzle array in the lengthwise direction of said first pressure generating chamber array and the lengthwise direction of said second pressure generating chamber array.

8. The ink jet recording head according to claim 1, wherein said pressure generating means comprises piezoelectric vibrators.

9. The ink jet recording head according to claim 1, wherein said pressure generating means comprises piezoelectric vibrating plates, an upper electrode, and a lower electrode.

10. The ink jet recording head according to claim 1, wherein said pressure generating means comprises:

cover plates; and a heating element having a protective layer on a first side and an electrically conductive layer on a second side.

11. The ink jet recording head according to claim 1, wherein said pressure generating chambers are arranged at positions staggered relative to one another so as to match said predetermined pattern formed by said nozzle openings.

12. The ink jet recording head according to claim 1, wherein said plurality of sets of communicating holes are arranged at positions staggered relative to one another so as to match said predetermined pattern formed by said nozzle openings.

13. The ink jet recording head according to claim 1, wherein said ink supply ports are arranged at positions staggered relative to one another so as to match said predetermined pattern formed by said nozzle openings.

14. A laminated ink jet recording head having a first pressure generating chamber array and a second pressure generating chamber array, said ink jet recording head comprising:

(A) an actuator unit comprising:

a pressure generating chamber forming board having pressure generating chambers for pressurizing ink, said pressure generating chambers forming said first and second pressure generating chamber arrays; and pressure generating means arranged on said pressure generating chamber forming board, said pressure generating means pressurizing said pressure generating chambers to jet the ink in said pressure generating chambers; and (B) a passage unit bonded to said actuator unit, comprising:

an ink supply port forming board having ink supply ports for supplying the ink to said pressure generating chambers of said actuator unit; and a nozzle plate having nozzle openings corresponding to said first pressure generating chamber array and said second pressure generating chamber array for jetting out the ink from said pressure generating chambers;

wherein said ink supply ports, said pressure generating chambers and said nozzle openings communicate via a plurality of sets of communicating holes provided in said actuator unit and said passage unit;

wherein said first pressure generating chamber array and said second pressure generating chamber array extend generally in a lengthwise direction;

wherein said nozzle openings corresponding to said first pressure generating chamber array extend generally in the lengthwise direction of said first pressure generating chamber array, and are staggered with respect to each other in a widthwise direction of said first pressure generating chamber array to form a predetermined pattern; and wherein said nozzle openings corresponding to said second pressure generating chamber array extend generally in the lengthwise direction of said second pressure generating chamber array, and are staggered with respect to each other in a widthwise direction of said second pressure generating chamber array to form the predetermined pattern.

15. The ink jet recording head according to claim 14, wherein said nozzle openings corresponding to said first pressure generating chamber array are staggered with respect to said nozzle openings corresponding to said second pressure generating chamber array in the lengthwise direction of said first pressure generating chamber array and the lengthwise direction of said second pressure generating chamber array.

16. The ink recording head according to claim 14, wherein said pressure generating chambers are arranged at positions staggered relative to one another so as to match said predetermined pattern formed by said nozzle openings.

17. The ink jet recording head according to claim 14, wherein said plurality of sets of communicating holes are arranged at positions staggered relative to one another so as to match said predetermined pattern formed by said nozzle openings.

18. The ink jet recording head according to claim 14, wherein said ink supply ports are arranged at positions staggered relative to one another so as to match said predetermined pattern formed by said nozzle openings.

19. A laminated ink jet recording head having a first nozzle array and a second nozzle array, said ink jet recording head comprising:

(A) an actuator unit comprising:

a pressure generating chamber forming board having pressure generating chambers for pressurizing ink; and pressure generating means arranged on said pressure generating chamber forming board, said pressure generating means pressurizing said pressure generating chambers to jet the ink in said pressure generating chambers; and (B) a passage unit bonded to said actuator unit, comprising:

an ink supply port forming board having ink supply ports for supplying the ink to said pressure generating chambers of said actuator unit; and a nozzle plate having nozzle openings, corresponding to said first nozzle array and said second nozzle array, for jetting out the ink from said pressure generating chambers;

wherein said ink supply ports, said pressure generating chambers and said nozzle openings communicate via a plurality of sets of communicating holes provided in said actuator unit and said passage unit; and wherein said nozzle openings corresponding to said first nozzle array and said nozzle openings corresponding to said second nozzle array extend generally in the lengthwise direction of said laminated ink jet recording head and are staggered with respect to each other in a widthwise direction of said laminated ink jet recording head to form a predetermined pattern.

20. The ink jet recording head of claim 19, wherein said pressure generating chambers are arranged at positions staggered relative to one another so as to match said predetermined pattern formed by said nozzle openings.

21. The ink jet recording head according to claim 19, wherein said plurality of sets of communicating holes are arranged at positions staggered relative to one another so as to match said predetermined pattern formed by said nozzle openings.

22. The ink jet recording head according to claim 19, wherein said ink supply ports are arranged at positions staggered relative to one another so as to match said predetermined pattern formed by said nozzle openings.

23. A laminated ink jet recording head, comprising:

(A) an actuator unit comprising:

a pressure generating chamber forming board having pressure generating chambers, forming pressure generating chamber arrays, for pressurizing ink; and pressure generating means arranged on said pressure generating chamber forming board, said pressure generating means pressurizing said pressure generating chambers to jet the ink in said pressure generating chambers; and (B) a passage unit bonded to said actuator unit, comprising:

an ink supply port forming board having ink supply ports for supplying the ink to said pressure generating chambers of said actuator unit; and a nozzle plate having nozzle openings, corresponding to said pressure generating chamber arrays, for jetting out the ink from said pressure generating chambers;

wherein said ink supply ports, said pressure generating chambers and said nozzle openings communicate via a plurality of sets of communicating holes provided in said actuator unit and said passage unit;

wherein said pressure generating chamber arrays extend generally in a lengthwise direction; and wherein said nozzle openings in each of said pressure generating chamber arrays extend generally in the lengthwise direction of said laminated ink jet recording head and are staggered with respect to each other in a widthwise direction of said laminated ink jet recording head to form a predetermined pattern.

24. The ink jet recording head according to claim 23, wherein said pressure generating chambers are arranged at positions staggered relative to one another so as to match said predetermined pattern formed by said nozzle openings.

25. The ink jet recording head according to claim 23, wherein said plurality of sets of communicating holes are arranged at positions staggered relative to one another so as to match said predetermined pattern formed by said nozzle openings.

26. The ink jet recording head according to claim 23, wherein said ink supply ports are arranged at positions staggered relative to one another so as to match said predetermined pattern formed by said nozzle openings.

27. A laminated ink jet recording head having a first nozzle array and a second nozzle array, said ink jet recording head comprising:

(A) an actuator unit comprising:

a pressure generating chamber forming board having pressure generating chambers for pressurizing ink; and pressure generating means arranged on said pressure generating chamber forming board, said pressure generating means pressurizing said pressure generating chambers to jet the ink in said pressure generating chambers; and (B) a passage unit bonded to said actuator unit, comprising:

an ink supply port forming board having ink supply ports for supplying the ink to said pressure generating chambers of said actuator unit; and a nozzle plate having nozzle openings, corresponding to said first nozzle array and said second nozzle array, for jetting out the ink from said pressure generating chambers;

wherein said ink supply ports, said pressure generating chambers and said nozzle openings communicate via a plurality of sets of communicating holes provided in said actuator unit and said passage unit;

wherein said first pressure generating chamber array extends generally in a lengthwise direction; and wherein said nozzle openings corresponding to said first nozzle array and said nozzle openings corresponding to said second nozzle array extend generally in the lengthwise direction of said laminated ink jet recording head and are staggered, alternately, with respect to each other in a widthwise direction of said laminated ink jet recording head to form a predetermined pattern.

28. The ink jet recording head according to claim 27, wherein said pressure generating chambers are arranged at positions staggered relative to one another so as to match said predetermined pattern formed by said nozzle openings.

29. The ink jet recording head according to claim 27, wherein said plurality of sets of communicating holes are arranged at positions staggered relative to one another so as to match said predetermined pattern formed by said nozzle openings.

30. The ink jet recording head according to claim 27, wherein said ink supply ports are arranged at positions staggered relative to one another so as to match said predetermined pattern formed by said nozzle openings.

* * * * *